US009506161B2

(12) United States Patent
Weng et al.

(10) Patent No.: US 9,506,161 B2
(45) Date of Patent: Nov. 29, 2016

(54) SURFACE TREATMENT OF A MAGNESIUM ALLOY

(71) Applicant: METAL INDUSTRIES RESEARCH & DEVELOPMENT CENTRE, Kaohsiung (TW)

(72) Inventors: Li-Wen Weng, Kaohsiung (TW); Chun-Chieh Tseng, Kaohsiung (TW); Yue-Jun Wang, Kaohsiung (TW); Ho-Chung Fu, Kaohsiung (TW); Tzyy-Ker Sue, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 0 days.

(21) Appl. No.: 14/568,210

(22) Filed: Dec. 12, 2014

(65) Prior Publication Data

US 2016/0168744 A1 Jun. 16, 2016

(51) Int. Cl.
*C25D 11/30* (2006.01)
*C25D 11/02* (2006.01)

(52) U.S. Cl.
CPC ..... *C25D 11/30* (2013.01); *C25D 11/024* (2013.01); *C25D 11/026* (2013.01)

(58) Field of Classification Search
CPC ..... C25D 11/30; C25D 11/024; C25D 11/16; C25D 11/24; C25D 11/26; C25D 11/026; C25D 13/14; B05D 3/142; B05D 2202/20; B05D 2202/25; B05D 2202/30; C23C 22/78; C23C 22/82; C23C 8/80; C23C 8/04; C23C 8/36; C23C 28/32; B60B 3/10
See application file for complete search history.

(56) References Cited

U.S. PATENT DOCUMENTS

| | | | | |
|---|---|---|---|---|
| 2,613,165 | A | 10/1952 | Fischer | |
| 6,335,099 | B1 * | 1/2002 | Higuchi | C25D 11/30 205/316 |
| 8,147,913 | B2 | 4/2012 | Chang et al. | |
| 2010/0131052 | A1 * | 5/2010 | Kappelt | A61L 31/022 623/1.46 |
| 2011/0048965 | A1 * | 3/2011 | Yun | C25D 11/30 205/724 |
| 2012/0031765 | A1 * | 2/2012 | Curran | B05D 3/142 205/50 |
| 2012/0125487 | A1 | 5/2012 | Chen | |
| 2012/0150295 | A1 * | 6/2012 | Dingeldein | A61L 31/022 623/11.11 |

FOREIGN PATENT DOCUMENTS

| | | | |
|---|---|---|---|
| CN | 103173838 | A | 6/2013 |
| CN | 103451700 | A | 12/2013 |
| WO | WO03/083181 | * | 10/2003 |

* cited by examiner

*Primary Examiner* — Xiuyu Tai
(74) *Attorney, Agent, or Firm* — Alan D. Kamrath; Kamrath IP Lawfirm, P.A.

(57) ABSTRACT

A surface treatment of a magnesium alloy includes preparing a substrate of magnesium alloy, micro-arc oxidizing the substrate of magnesium alloy, forming an oxide layer with a hydroxyl group on the substrate of magnesium alloy, silylizing the oxide layer of the substrate of magnesium alloy with the oxide layer, by soaking the substrate of magnesium alloy in a processing solution with a silyl group-containing compound for 1-300 minutes, and placing the substrate of magnesium alloy with the silylized oxide layer at 70-200° C. for 1-300 minutes, allowing a condensation reaction to occur. The manufactured surface-treated magnesium alloy shows a decreased degradation rate in vivo.

15 Claims, 7 Drawing Sheets

SURFACE TREATMENT OF A MAGNESIUM ALLOY

BACKGROUND OF THE INVENTION

1. Field of the Invention

The present invention generally relates to a surface treatment and, more particularly, to a surface treatment of a magnesium alloy.

2. Description of the Related Art

Magnesium is a light-weight metal with properties (such as density and coefficient of elasticity) similar to periosteum, and also, magnesium is a bio-degradable material with great mechanical properties. Thus, a magnesium alloy containing magnesium and other metals poses potential to use as a biomaterial to replace other biomaterials, such as titanium alloy or stainless steel.

However, the magnesium alloy shows poor corrosion resistance and degrades rapidly in vivo, releasing excess magnesium ions ($Mg^{2+}$) and hydrogen ions ($H^+$) within a short time. Although magnesium ions are usable in human bodies, the accumulated, excess hydrogen ions will reduce pH values of body fluids, causing the insufficient oxygen supply to tissues, thereby leading to abnormality of human bodies.

In light of this, it is necessary to provide a surface treatment of the magnesium alloy, solving the difficulty in rapidly degradation in vivo.

SUMMARY OF THE INVENTION

It is therefore the objective of an embodiment of the present invention to provide a surface treatment of magnesium alloy to manufacture a surface-treated magnesium alloy with a decreased degradation rate in vivo.

It is another objective of an embodiment of the invention to provide a surface treatment of magnesium alloy to manufacture a surface-treated magnesium alloy suitable for a biomaterial.

The present invention fulfills the above objectives by providing a surface treatment of a magnesium alloy for manufacturing a surface-treated magnesium alloy, which includes the following steps. A substrate of magnesium alloy is prepared. The substrate of magnesium alloy is micro-arc oxidized to form an oxide layer with a hydroxyl group on a surface of the substrate of magnesium alloy. The oxide layer of the substrate of magnesium alloy is silylized by soaking the substrate of magnesium alloy with the oxide layer in a processing solution with a silyl group-containing compound, allowing the silyl group-containing compound to adhere on the oxide layer of the substrate of magnesium alloy. The substrate of magnesium alloy with the silylized oxide layer is heated at 70-200° C., allowing a condensation reaction in which the silyl group of the silyl group-containing compound combines with the hydroxyl group of the oxide layer, and in which there is a loss of water.

In a preferred form shown, the substrate of magnesium alloy with the oxide layer is soaked in the processing solution for 1-300 minutes.

In a preferred form shown, the substrate of magnesium alloy with the silylized oxide layer is heated for 1-300 minutes.

In a preferred form shown, the silyl group-containing compound is selected from (3-aminopropyl)triethoxysilane, (3-mercaptopropyl)trimethoxysilane or bis(trimethysilyl) amine.

In a preferred form shown, the processing solution includes 3-20 wt % of the silyl group-containing compound.

In a preferred form shown, the substrate of magnesium alloy with the oxide layer is soaked in the processing solution for 10-60 minutes.

In a preferred form shown, the substrate of magnesium alloy with the silylized oxide layer is heated at 80-150° C. for 20-60 minutes.

In a preferred form shown, the oxide layer includes oxides of magnesium selected from a group consisting of magnesium oxide (MgO), magnesium hydroxide ($Mg(OH)_2$) and magnesium silicate ($MgSiO_4$ and $Mg_2SiO_3$).

In a preferred form shown, the surface-treated magnesium alloy includes a condensed oxide layer with a thickness of 5-50 μm.

In a preferred form shown, the surface-treated magnesium alloy includes a condensed oxide layer having a first surface coupling to the substrate of magnesium alloy and a second surface opposite to the first surface. The condensed oxide layer is a porous layer with a plurality of pores. The condensed oxide layer is sequentially divided into a first sublayer, a second sublayer and a third sublayer from the second surface to the first surface, with the first layer having a thickness smaller than 5 μm and a porosity of 3-5%, with the second layer having a thickness smaller than 5 μm and a porosity of 2-3%, and with the third layer having porosity smaller than 1%.

In a preferred form shown, the oxide layer is a porous layer with a plurality of pores. The surface treatment of the magnesium alloy further includes the following step. The plurality of pores of the oxide layer is shrunk by soaking the substrate of magnesium alloy with the oxide layer in water at 70-150° C. before the substrate of magnesium alloy with the oxide layer is soaked in the processing solution.

In a preferred form shown, the substrate of magnesium alloy with the oxide layer is soaked in water for 1-300 minutes.

In a preferred form shown, the substrate of magnesium alloy is micro-arc oxidized for 5-30 minutes using a current density of 20-500 $mA/cm^2$, a pulse frequency of 500-5,000 Hz and a duty cycle of 10-60%.

In a preferred form shown, the substrate of magnesium alloy is micro-arc oxidized by immersing the substrate of magnesium alloy in an alkaline electrolyte.

In a preferred form shown, the surface treatment of the magnesium alloy further includes preparing the alkaline electrolyte by mixing of sodium hydroxide (NaOH), trisodium phosphate ($Na_3PO_4$), sodium nestasilicate ($Na_2SiO_3$), chelating agents and calcium salts.

The present invention also fulfills the above objectives by providing a surface-treated magnesium alloy manufactured by the surface treatment mentioned above.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1A:
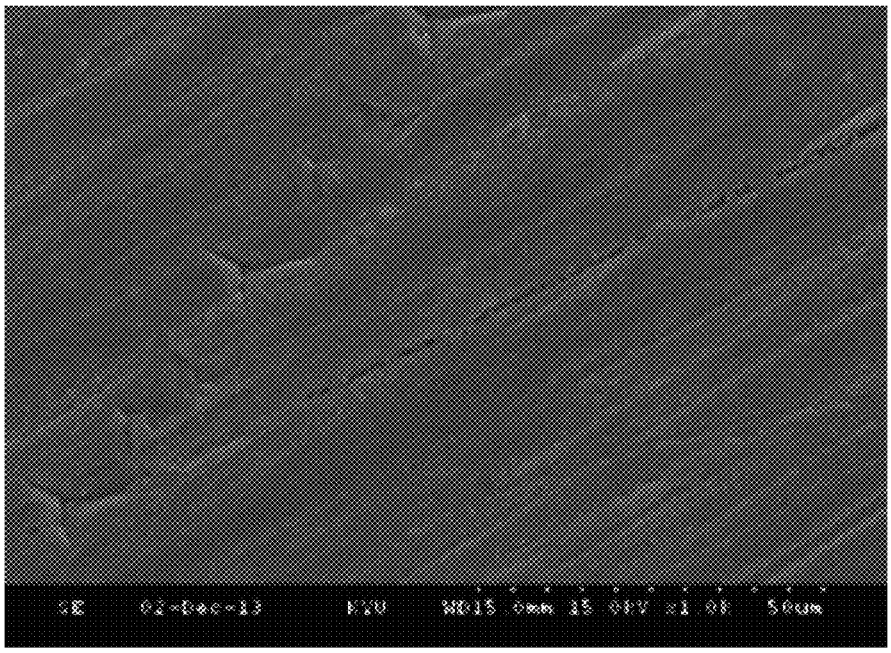
FIG. 1A is a surface SEM image of group A0 being the substrate of magnesium alloy.
Figure 1B:
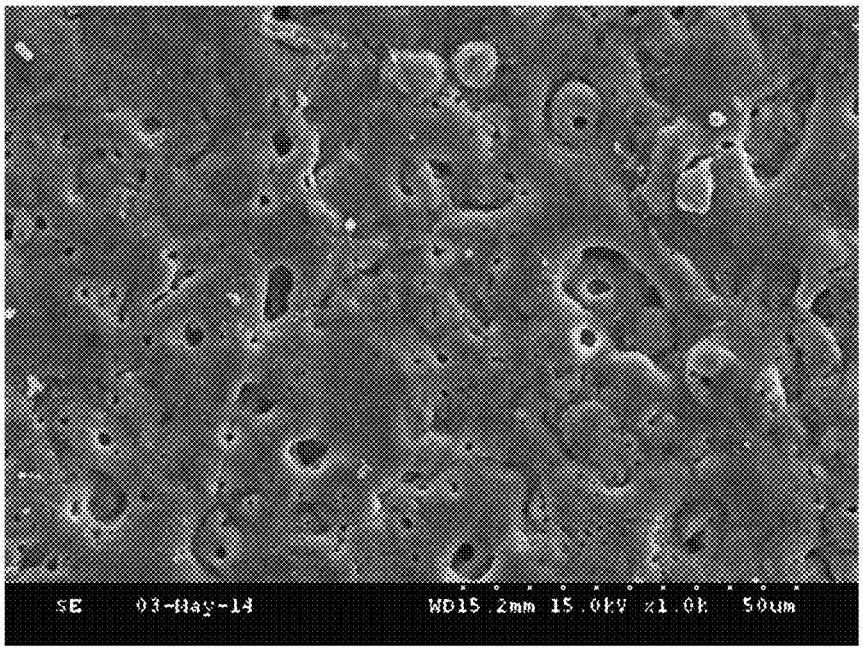
FIG. 1B is a surface SEM image of group A1 being the substrate of magnesium alloy with the oxide layer formed by the micro-arc oxidation.
Figure 1C:
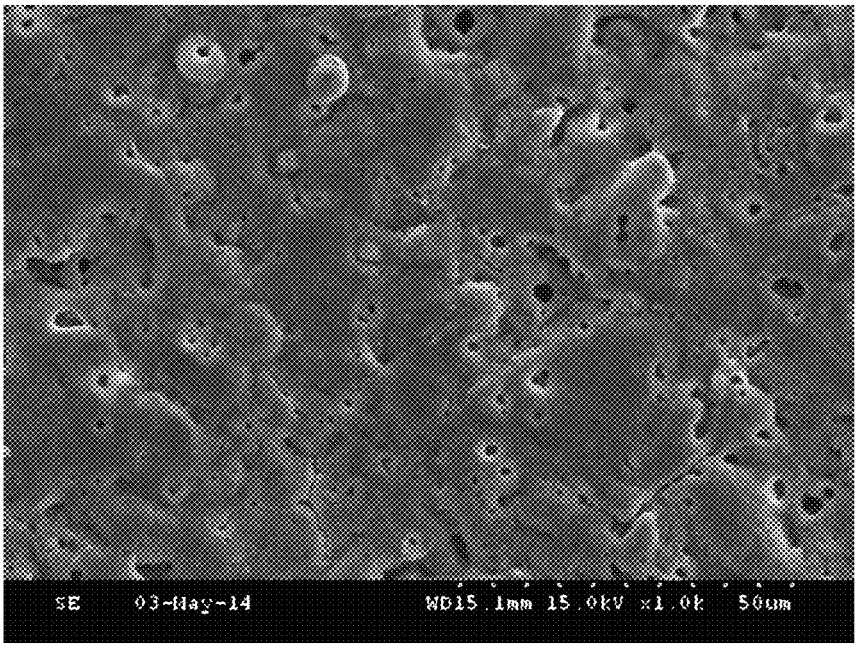
FIG. 1C is a surface SEM image of group A2 being the surface-treated magnesium alloy manufactured by the surface treatment according to the present invention.
Figure 1D:
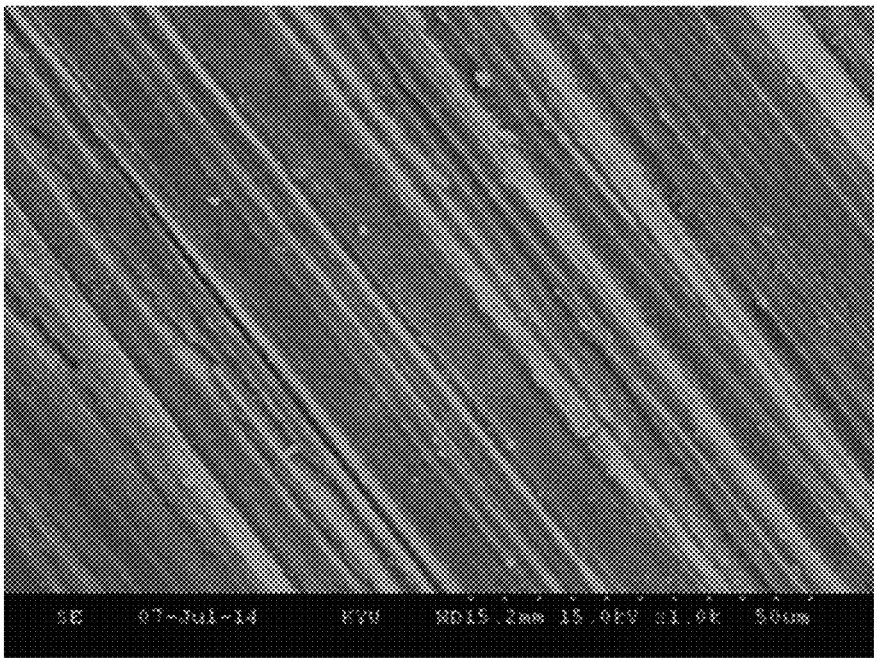
FIG. 1D is a surface SEM image of group B0 being the substrate of magnesium alloy.
Figure 1E:
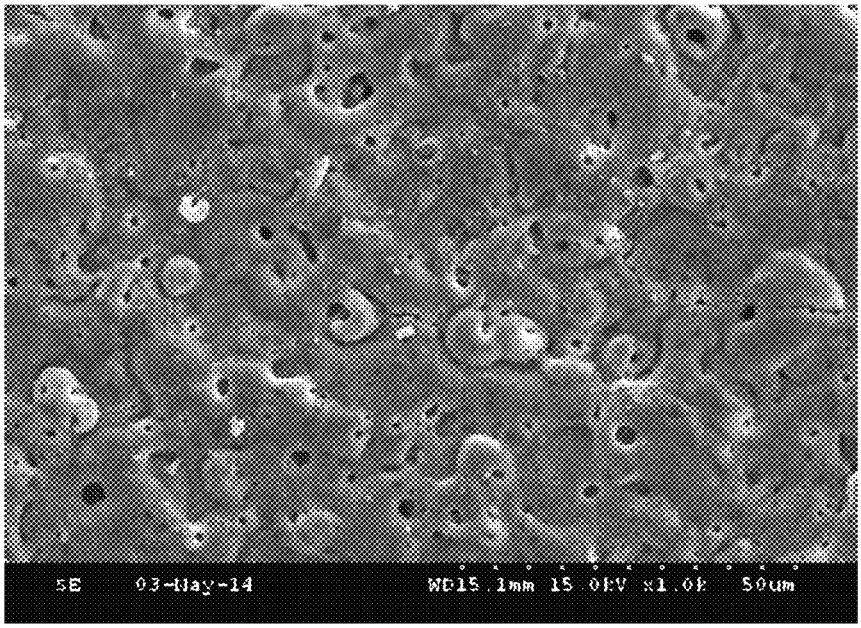
FIG. 1E is a surface SEM image of group B1 being the substrate of magnesium alloy with the oxide layer formed by the micro-arc oxidation.
Figure 1F:
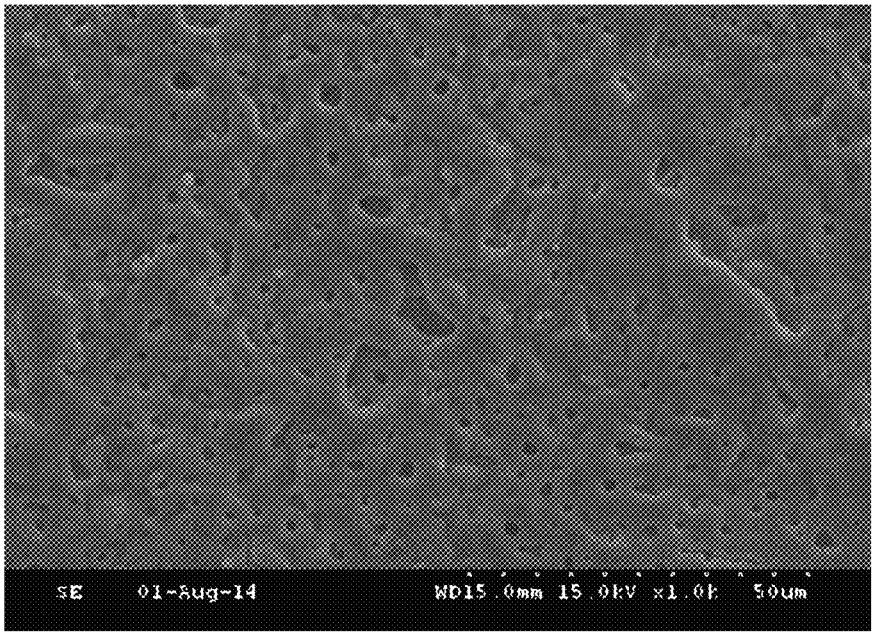
FIG. 1F is a surface SEM image of group B2 being the surface-treated magnesium alloy manufactured by the surface treatment according to the present invention.

In the various figures of the drawings, the same numerals designate the same or similar parts. Furthermore, when the term "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

A surface treatment of a magnesium alloy for manufacturing a surface-treated magnesium alloy according to the present invention includes the following steps. A substrate of magnesium alloy is prepared. The substrate of magnesium alloy is micro-arc oxidized to form an oxide layer on a surface of the substrate of magnesium alloy. The oxide layer of the substrate of magnesium alloy is silylized by soaking the substrate of magnesium alloy with the oxide layer in a processing solution with a silyl group-containing compound. The substrate of magnesium alloy with the silylized oxide layer is heated to allow a condensation reaction to occur.

Specifically, the substrate of magnesium alloys can be magnesium alloys used for casting, welding or hot extrusion. The substrates of magnesium alloys are mixtures of magnesium with other metals, such as aluminum (Al), zinc (Zn), manganese (Mn), cerium (Ce), thorium (Th) or zirconium (Zr). For example, the substrates of magnesium alloys can be aluminum-containing magnesium alloys, manganese-containing magnesium alloys, aluminum and zinc-containing magnesium alloys or zinc and zirconium-containing magnesium alloys. Practically, the substrates of magnesium alloys can be, but are not limited to, AZ31 (with 3-3.2 wt % of Al, 0.8 wt % of Zn and 0.4 wt % of Mn), AK91 or ZK60 (with 6.3 wt % of Zn, 0.49 wt % of Zr). The outline of the substrates of magnesium alloys is not limited. In this embodiment, the substrate of magnesium alloy is AZ31 or ZK60, which has the outline of a sheet. Moreover, due to the medical concerns of aluminum, compared to the rarely aluminum-containing AZ31 (about 3 wt %) with the improved corrosion resistance, the aluminum absent ZK60 is preferably used as the substrate of magnesium alloy.

Before the oxide layer is formed on the surface of the substrate of magnesium alloy by micro-arc oxidation, the substrate of magnesium alloy can first undergo a pretreatment process, by milling the surface of the substrate of magnesium alloy. The surface-milled substrate of magnesium alloy can be washed sequentially by a sodium hydroxide solution (10 wt % in water) for 180 seconds and an acetic acid solution (96 wt % in water) for 30 seconds. The washed substrate of magnesium alloy can be further soaked in an anhydrous alcohol solution, followed by drying to remove the anhydrous alcohol solution. Such that, the incompact oxide layer possibly formed on the surface of the substrate of magnesium alloy can be removed, improving the efficiency of the following micro-arc oxidation.

The micro-arc oxidation can be further carried out to form the oxide layer on the surface of the substrate of magnesium alloy. During the micro-arc oxidation, thermochemical, electrochemical and electroplasma reactions occur, the substrate of magnesium alloy may undergo melting, erupting, crystallization and phase transition at high temperature, and the oxide layer can be finally formed on the surface of the substrate of magnesium alloy. The oxide layer is a porous layer with a plurality of pores. The oxide layer has a major component of oxides of magnesium. In this embodiment, the compact oxide layer includes oxides of magnesium selected from a group consisting of magnesium oxide (MgO), magnesium hydroxide ($Mg(OH)_2$) and magnesium silicate ($MgSiO_4$ and $Mg_2SiO_3$).

In detail, the substrate of magnesium alloy is soaked in an electrolyte, with the substrate of magnesium alloy and a stainless steel being used as the anode and the cathode, respectively. After the application of currents between the anode and the cathode, the oxide layer can be formed on the surface of the substrate of magnesium alloy. In this embodiment, a pulse current is applied between the anode and the cathode, with the pulse current having a current density of 20-500 mA/cm$^2$, a pulse frequency of 500-5,000 Hz, a duty cycle of 10-60% and a current applying period of 5-30 minutes. With such performance, the oxide layer formed on the surface of the substrate of magnesium alloy shows a proper corrosion resistance.

It is worthy to mention that the electrolyte is an alkaline electrolyte prepared by mixing of sodium hydroxide (NaOH), trisodium phosphate ($Na_3PO_4$), sodium nestasilicate ($Na_2SiO_3$), chelating agents and calcium salts. The composition of the electrolyte will effect the composition of the oxide layer, which is understood by a person having ordinary skill in the art. Moreover, the alkaline electrolyte used in this embodiment shows advantages including reduced pollution and decreased difficulties in obtaining because of the easily obtainable components.

Preferably, the substrate of magnesium alloy with the oxide layer can be soaked in water at 70-150° C. for a period time before the substrate of magnesium alloy with the oxide layer is soaked in the processing solution, shrinking the plurality of pores of the oxide layer. The period time for soaking in water can be 1-300 minutes, such that the oxide layer with the plurality of shrunk pores can block water and gas. Therefore, the substrate of magnesium with the oxide layer with the plurality of shrunk pores has an improved corrosion resistance. In this embodiment, the substrate of magnesium alloy with the oxide layer is soaked in water at 100° C. for 15-30 minutes, followed by drying at 60° C. for 2 hours. The dried substrate of magnesium alloy with the oxide layer with the plurality of shrunk pores can be used in the following processes.

The substrate of magnesium alloy with the oxide layer is soaked in the processing solution for 1-300 minutes, allowing the silylation to occur. That is, the silyl group-containing compound in the processing solution is adherent to the outer periphery of the oxide layer. Specifically, the silyl group-containing compound in the processing solution can be selected from, but is not limited to, (3-aminopropyl)triethoxysilane (APTES), (3-mercaptopropyl)trimethoxysilane (MPTMS) or bis(ttimethysilyl)amine (HMDS). In this embodiment, the silyl group-containing compound is MPTMS. Preferably, the substrate of magnesium alloy is soaked in the processing solution in a vacuum environment, avoiding the processing solution going bad. Moreover, the processing solution preferably includes 3-20 wt % of the silyl group-containing compound. In this embodiment, the substrate of magnesium alloy is soaked in the processing solution for 10-60 minutes, allowing the adhesion of the silyl group-containing compound on the outer periphery of the oxide layer.

Finally, the substrate of magnesium alloy with the silylized oxide layer is heated at 70-200° C. to allow a condensation reaction to occur, such that the silyl group-containing compound adherent to the outer periphery of the oxide layer can interact with the oxide layer-containing hydroxyl group, and such that the resultant water evaporates due to the high temperature (70-200° C.). In this embodiment, the substrate of magnesium alloy with the silylized oxide layer is heated at 80-150° C. for 20-60 minutes to obtain a surface-treated magnesium alloy.

The surface-treated magnesium alloy according to the present invention is manufactured by the surface treatment of the magnesium alloy discussed above. The surface-treated magnesium alloy includes the substrate of magnesium alloy and the condensed oxide layer. The condensed oxide layer has a first surface coupling to the substrate of magnesium alloy and a second surface opposite to the first surface. The condensed oxide layer has a thickness of about 5-50 μm with a decreasing porosity from the second surface to the first surface. Specifically, the condensed oxide layer is sequentially divided into a first sublayer, a second sublayer and a third sublayer from the second surface to the first surface, with the first sublayer having a thickness of 5 μm and a porosity of 3-5%, with the second sublayer having a thickness of 5 μm and a porosity of 2-3%, and with the third sublayer having a thickness of 40 μm and a porosity smaller than 1%. With such performance, the condensed oxide layer on the surface of the substrate of magnesium alloy shows an improved corrosion resistance.

In order to evaluate whether the surface-treated magnesium alloy has the improved corrosion resistance and the decreased degradation rate in vivo, trials (A) to (C) are carried out as follows.

Trial (A). Electrochemical Analysis

In trial (A), AZ31 and ZK60 are used as the substrates of magnesium alloy of groups A0 and B0, respectively. The AZ31 with the oxide layer and the ZK60 with the oxide layer formed by the micro-arc oxidation are used as groups A1 and B1, respectively. The surface-treated AZ31 and the surface-treated ZK60 by silylation and condensation are used as groups A2 and B2, respectively. The corrosion current densities of each group are shown in TABLE 1.

TABLE 1

| Groups | Substrate of magnesium alloy | Micro-arc oxidation | Silylation & Condensation | Corrosion current density (mA/cm$^2$) |
|---|---|---|---|---|
| A0 | AZ31 | − | − | 290 |
| A1 | AZ31 | + | − | 8.07 |
| A2 | AZ31 | + | + | 2.08 |
| B0 | ZK60 | − | − | 253 |
| B1 | ZK60 | + | − | 45 |
| B2 | ZK60 | + | + | 19.8 |

With respect to TABLE 1, the corrosion current density of group A2 is smaller than the corrosion current density of group A1, and the corrosion current density of groups A1 and A2 are smaller than the corrosion current density of group A0. The similar result can also be observed in groups B0, B1 and B2. As a result, the oxide layer on the substrate of magnesium alloy formed by the micro-arc oxidation can effectively improve the corrosion resistance of the substrate of magnesium alloy. Moreover, silylation and condensation reaction can further improve the corrosion resistance of the substrate of magnesium alloy. That is, the surface treatment of a magnesium alloy according to the present invention can effectively improve the corrosion resistance of the magnesium alloy.

Trial (B). SEM Image Analysis

Figure 2:
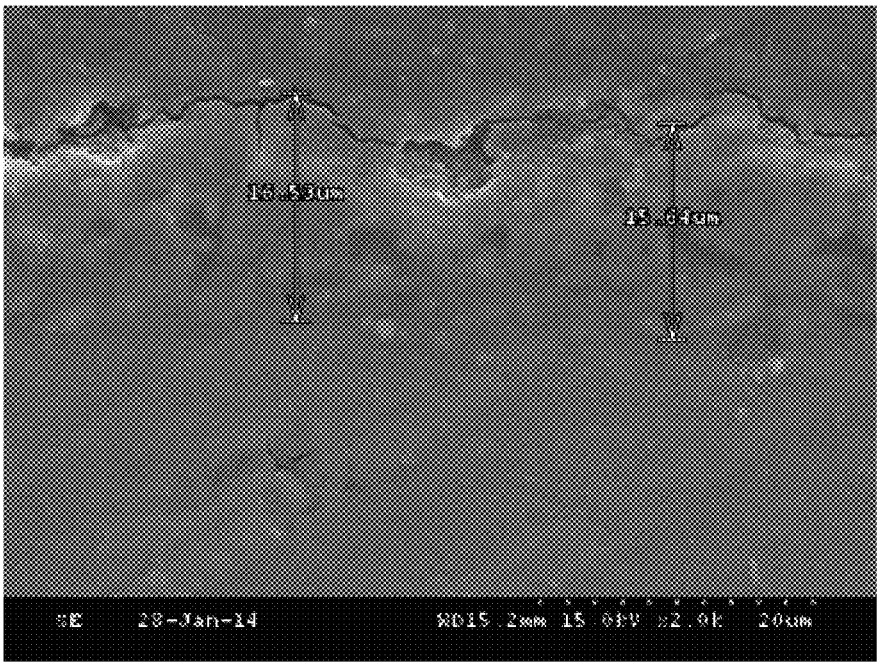
FIG. 2 is a section SEM image of group A2 being the surface-treated magnesium alloy manufactured by the surface treatment according to the present invention.

The surface SEM images of groups A0-A2 and B0-B2 are shown in FIGS. 1A-1F, showing the surfaces of groups A1, A2, B1 and B2 are not smooth. Moreover, groups A1-A2 and B1-B2 have the oxide layer with a plurality of pores. In addition, the section SEM image shown in FIG. 2 demonstrates the oxide layer of group A2 has a thickness of about 15-16 μm with corrosion resistance.

Trial (C). Salt Spray Test ASTM B-117

The salt spray test is carried out according to the standard ASTM B-117. The samples and the corresponding surface SME images are shown in TABLE 2.

TABLE 2

Figure 3A:
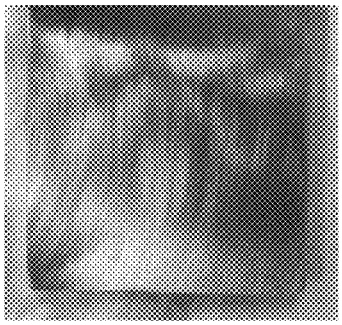
FIG. 3A is a surface SEM image of group A0 being the substrate of magnesium alloy, illustrating the corrosion resistance before the salt spray test ASTM B-117.
Figure 3B:
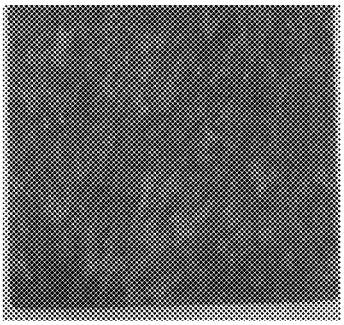
FIG. 3B is a surface SEM image of group A1 being the substrate of magnesium alloy with the oxide layer formed by the micro-arc oxidation, illustrating the corrosion resistance before the salt spray test ASTM B-117.
Figure 3C:
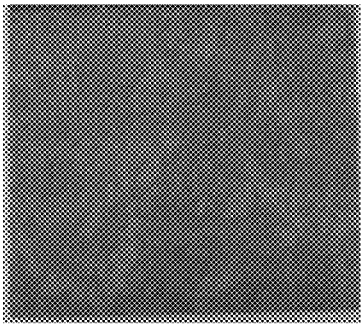
FIG. 3C is a surface SEM image of group A2 being the surface-treated magnesium alloy manufactured by the surface treatment according to the present invention, illustrating the corrosion resistance before the salt spray test ASTM B-117.
Figure 3D:
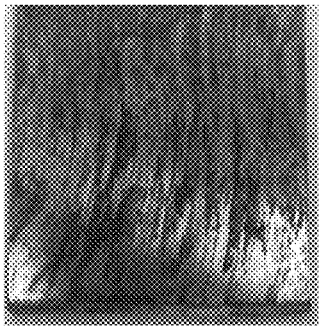
FIG. 3D is a surface SEM image of group A0 being the substrate of magnesium alloy, illustrating the corrosion resistance after the salt spray test ASTM B-117.
Figure 3E:
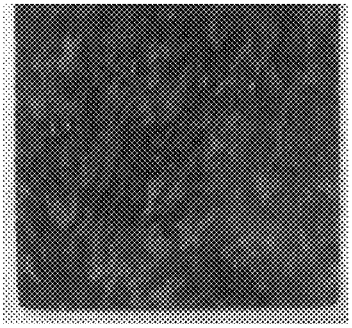
FIG. 3E is a surface SEM image of group A1 being the substrate of magnesium alloy with the oxide layer formed by the micro-arc oxidation, illustrating the corrosion resistance after the salt spray test ASTM B-117.
Figure 3F:
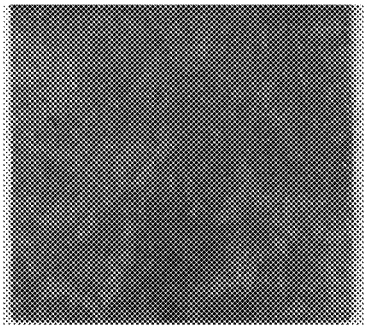
FIG. 3F is a surface SEM image of group A2 being the surface-treated magnesium alloy manufactured by the surface treatment according to the present invention, illustrating the corrosion resistance after the salt spray test ASTM B-117.
Figure 4A:
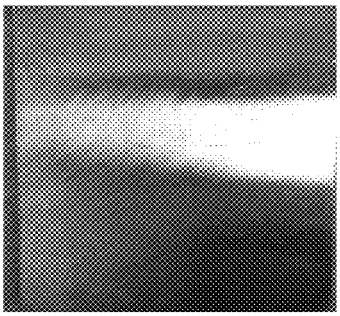
FIG. 4A is a surface SEM image of group B0 being the substrate of magnesium alloy, illustrating the corrosion resistance before the salt spray test ASTM B-117.
Figure 4B:
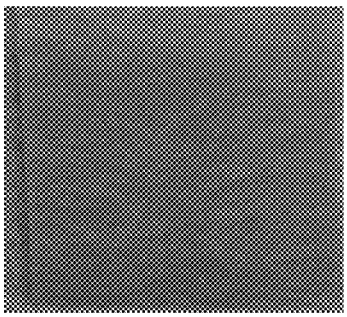
FIG. 4B is a surface SEM image of group B1 being the substrate of magnesium alloy with the oxide layer formed by the micro-arc oxidation, illustrating the corrosion resistance before the salt spray test ASTM B-117.
Figure 4C:
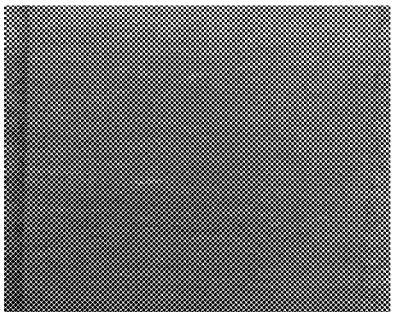
FIG. 4C is a surface SEM image of group B2 being the surface-treated magnesium alloy manufactured by the surface treatment according to the present invention, illustrating the corrosion resistance before the salt spray test ASTM B-117.
Figure 4D:
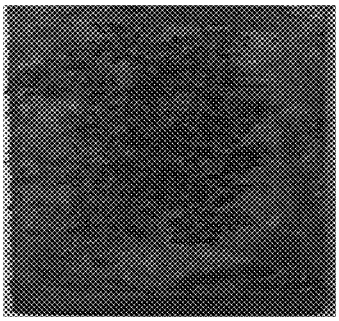
FIG. 4D is a surface SEM image of group B0 being the substrate of magnesium alloy, illustrating the corrosion resistance after the salt spray test ASTM B-117.
Figure 4E:
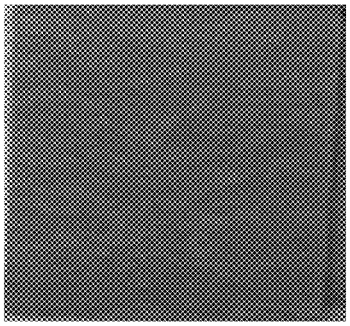
FIG. 4E is a surface SEM image of group B1 being the substrate of magnesium alloy with the oxide layer formed by the micro-arc oxidation, illustrating the corrosion resistance after the salt spray test ASTM B-117.
Figure 4F:
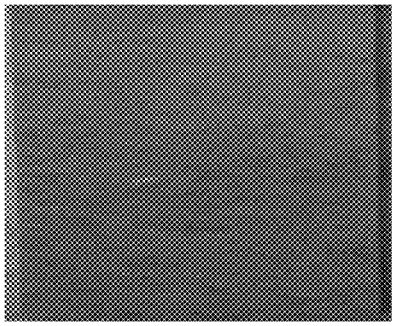
FIG. 4F is a surface SEM image of group B2 being the surface-treated magnesium alloy manufactured by the surface treatment according to the present invention, illustrating the corrosion resistance after the salt spray test ASTM B-117.

| Groups | Substrate of magnesium alloy | Micro-arc oxidation | Silylation & Condensation | Surface SME images Before | Surface SME images After |
|---|---|---|---|---|---|
| A0 | AZ31 | – | – | FIG. 3A | FIG. 3D |
| A1 | AZ31 | + | – | FIG. 3B | FIG. 3E |
| A2 | AZ31 | + | + | FIG. 3C | FIG. 3F |
| B0 | ZK60 | – | – | FIG. 4A | FIG. 4D |
| B1 | ZK60 | + | – | FIG. 4B | FIG. 4E |
| B2 | ZK60 | + | + | FIG. 4C | FIG. 4F |

Referring to FIGS. 3A-3F, group A0 (AZ31) shows a severe corrosion, while groups A1 (AZ31 with the oxide layer formed by the micro-arc oxidation) and A2 (the surface-treated magnesium alloy manufactured by the surface treatment according to the present invention) show no obvious corrosion. The similar results are also shown in FIGS. 4A-4F. That is, the surface treatment according to the present invention can improve the corrosion resistance of the substrate of magnesium alloy.

Trial (D). Section SEM of the Surface-Treated Magnesium Alloy

Figure 5:
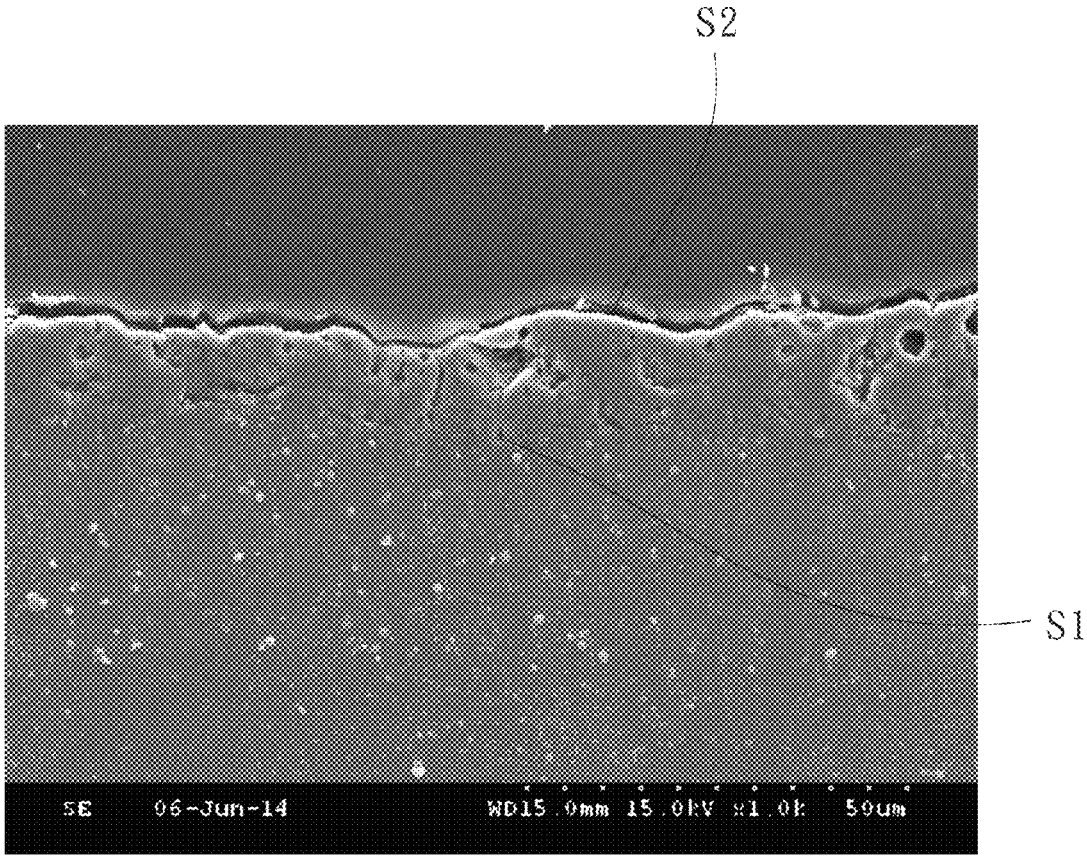
FIG. 5 is a section SEM image of the surface-treated magnesium alloy manufactured by the surface treatment according to the present invention.

Referring to FIG. 5, the condensed oxide layer has a first surface "S1" and a second surface "S2" with the plurality of pores forming between the first surface "S1" and the second surface "S2". Moreover, the condensed oxide layer can be sequentially divided into a first sublayer, a second sublayer and a third sublayer from the second surface "S2" to the first surface "S1". The first sublayer has a thickness of 5 μm and a porosity of 3-5%, the second sublayer has a thickness of 5 μm and a porosity of 2-3%, and the third sublayer has a thickness of 40 μm and a porosity smaller than 1%.

In view of the foregoing, the surface-treated magnesium alloy manufactured by the surface treatment of the magnesium alloy according to the present invention shows the improved corrosion resistance and a decreased degradation rate in vivo. Moreover, when the surface-treated magnesium alloy is used as the biomaterial, the surface-treated magnesium alloy can release magnesium ions ($Mg^{2+}$) and hydrogen ions ($H^+$) in a steady manner, thereby avoiding acute decrease of pH values of body fluids.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A surface treatment of a magnesium alloy for manufacturing a surface-treated magnesium alloy, comprising:

preparing a substrate of magnesium alloy;

preparing an alkaline electrolyte consisting of sodium hydroxide (NaOH), trisodium phosphate ($Na_3PO_4$), sodium nestasilicate ($Na_2SiO_3$), chelating agents and calcium salts;

micro-arc oxidizing the substrate of magnesium alloy by immersing the substrate of magnesium alloy in the alkaline electrolyte, forming an oxide layer with a hydroxyl group on a surface of the substrate of magnesium alloy;

silylizing the oxide layer of the substrate of magnesium alloy, by soaking the substrate of magnesium alloy with the oxide layer in a processing solution having a silyl group-containing compound, allowing the silyl group-containing compound adhering on the oxide layer of the substrate of magnesium alloy; and heating the substrate of magnesium alloy with the silylized oxide layer at 70-200° C., allowing a condensation reaction to occur in which combines the silyl group of the silyl group-containing compound and the hydroxyl group of the oxide layer, together with loss of water.

2. The surface treatment of the magnesium alloy as claimed in claim 1, with soaking the substrate of magnesium alloy with the oxide layer in the processing solution for 1-300 minutes.

3. The surface treatment of the magnesium alloy as claimed in claim 1, with heating the substrate of magnesium alloy with the silylized oxide layer for 1-300 minutes.

4. The surface treatment of the magnesium alloy as claimed in claim 1, with the silyl group-containing compound being selected from (3-aminopropyl)triethoxysilane, (3-mercaptopropyl)trimethoxysilane or bis(trimethysilyl) amine.

5. The surface treatment of the magnesium alloy as claimed in claim 1, with the processing solution comprising 3-20 wt % of the silyl group-containing compound.

6. The surface treatment of the magnesium alloy as claimed in claim 1, with soaking the substrate of magnesium alloy with the oxide layer in the processing solution for 10-60 minutes.

7. The surface treatment of the magnesium alloy as claimed in claim 1, with heating the substrate of magnesium alloy with the silylized oxide layer at 80-150° C. for 20-60 minutes.

8. The surface treatment of the magnesium alloy as claimed in claim 1, with the oxide layer comprising oxides of magnesium selected from a group consisting of magnesium oxide (MgO), magnesium hydroxide ($Mg(OH)_2$) and magnesium silicate ($MgSiO_4$ and $Mg_2SiO_3$).

9. The surface treatment of the magnesium alloy as claimed in claim 1, with the surface-treated magnesium alloy comparing a condensed oxide layer having a thickness of 5-50 μm.

10. The surface treatment of the magnesium alloy as claimed in claim 1, with the surface-treated magnesium alloy comprising a condensed oxide layer having a first surface coupling to the substrate of magnesium alloy and a second surface opposite to the first surface, with the condensed oxide layer being a porous layer with a plurality of pores, with the condensed oxide layer being sequentially divided into a first sublayer, a second sublayer and a third sublayer from the second surface to the first surface, with the first sublayer having a thickness of 5 μm and a porosity of 3-5%, with the second sublayer having a thickness of 5 μm and a porosity of 2-3%, with the third sublayer having a thickness of 40 μm and a porosity smaller than 1%.

11. The surface treatment of the magnesium alloy as claimed in claim 1, with the oxide layer being a porous layer with a plurality of pores, with the surface treatment of the magnesium alloy further comprising:

shrinking the plurality of pores of the oxide layer, by soaking the substrate of magnesium alloy with the oxide layer in water at 70-150° C. before the substrate of magnesium alloy with the oxide layer is soaked in the processing solution.

12. The surface treatment of the magnesium alloy as claimed in claim 11, with soaking the substrate of magnesium alloy with the oxide layer in water for 1-300 minutes.

13. The surface treatment of the magnesium alloy as claimed in claim 1, with micro-arc oxidating the substrate of magnesium alloy for 5-30 minutes using a current density of 20-500 mA/cm2, a pulse frequency of 500-5,000 Hz and a duty cycle of 10-60%.

14. A surface-treated magnesium alloy, by manufacturing by the surface treatment of the magnesium alloy as claimed in claim 1.

15. The surface treatment of the magnesium ahoy as claimed in claim 1, wherein soaking the substrate of magnesium ahoy is under a vacuum environment.

* * * * *